US006292648B1

(12) United States Patent
Higaya et al.

(10) Patent No.: US 6,292,648 B1
(45) Date of Patent: Sep. 18, 2001

(54) FIXING DEVICE USING INDUCTION HEATING FOR IMAGE FORMING APPARATUS

(75) Inventors: Toshiaki Higaya, Kanagawa; Tomotaka Takamura, Miyagi, both of (JP)

(73) Assignees: Ricoh Company, Ltd., Tokyo; Tohoku Ricoh Co., Ltd., Shibata-gun, both of (JP)

( * ) Notice: Subject to any disclaimer, the term of this patent is extended or adjusted under 35 U.S.C. 154(b) by 0 days.

(21) Appl. No.: 09/559,380

(22) Filed: Apr. 27, 2000

(30) Foreign Application Priority Data

Apr. 28, 1999 (JP) ..... 11-121641

(51) Int. Cl.[7] ..... G03G 15/20

(52) U.S. Cl. ..... 399/335; 219/216; 219/469; 399/330

(58) Field of Search ..... 399/335, 336, 399/328, 330, 320; 219/216, 469–471

(56) References Cited

U.S. PATENT DOCUMENTS

| | | |
|---|---|---|
| Re. 36,124 | 3/1999 | Yokohama et al. . |
| 5,300,996 | 4/1994 | Yokoyama et al. . |
| 5,426,495 | 6/1995 | Sawamura et al. . |
| 5,594,540 | 1/1997 | Higaya et al. . |
| 5,832,354 | 11/1998 | Kouno et al. . |
| 5,915,147 | 6/1999 | Kouno et al. . |

FOREIGN PATENT DOCUMENTS

| | | | |
|---|---|---|---|
| 57-133466 | * | 8/1982 | (JP) . |
| 62-264768 | * | 11/1987 | (JP) . |
| 4-289888 | * | 10/1992 | (JP) . |
| 5-341683 | * | 12/1993 | (JP) . |
| 7-295414 | * | 11/1995 | (JP) . |
| 8-137311 | | 5/1996 | (JP) . |
| 11-297463 | | 10/1999 | (JP) . |
| 11-311910 | | 11/1999 | (JP) . |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A fixing device using induction heating for an electrophotographic image forming apparatus includes a heat roller and a press roller for fixing a toner image on a recording medium while conveying the recording medium. A coil unit is located outside of the heat roller and upstream of a nip between the heat roller and the press roller in the direction of rotation of the heat roller for generating an induced magnetic flux. The coil unit concentratedly heats the heat roller and thereby efficiently feeds heat to the recording medium.

21 Claims, 6 Drawing Sheets

FIXING DEVICE USING INDUCTION HEATING FOR IMAGE FORMING APPARATUS

BACKGROUND OF THE INVENTION

The present invention relates to a fixing device for a printer, facsimile apparatus, copier or similar electrophotographic image forming apparatus. More particularly, the present invention relates to a fixing device of the type generating heat based on electromagnetic induction.

Generally, an image forming apparatus of the type using toner for developing a latent image includes a fixing device implemented by a heat roller and a press roller. The heat roller and press roller fix a toner image formed on a paper sheet or similar recording medium with heat and pressure while conveying the recording medium. A halogen lamp has customarily been disposed in the heat roller as a heat source for heating the inner periphery of the heat roller to a preselected temperature. A problem with the halogen lamp is that a substantial period of time is necessary for the lamp to heat the heat roller to the preselected temperature. This, coupled with the substantial loss of the halogen lamp itself, makes the lamp undesirable from the global environment standpoint.

In light of the above, a fixing device using induction heating is attracting increasing attention as a fixing device that is efficient and needs a minimum of warm-up time. This type of fixing device includes an induction heating device implemented by an induction coil. The induction coil is disposed in a heat roller and wound around a cylindrical bobbin formed of an insulator. High frequency current is fed to the induction coil via leads extending out from opposite ends of the coil. The high frequency current forms a high frequency magnetic field which in turn generates induced eddy current in the core or metallic conductor of the heat roller. As a result, the heat roller itself generates heat due to its own skin resistance on the basis of Joule heat. In this manner, the surface of the heat roller is heated to a desired temperature.

In the above induction heating device, the induction coil is disposed in the heat roller in place of the conventional halogen lamp so as not to obstruct the conveyance of a paper sheet. The induction coil therefore heats the entire inner periphery of the heat roller like a halogen lamp. This brings about a problem that heat generated in portions other than the nip between the heat roller and a press roller, which needs thermal energy, is simply wasted.

Technologies relating to the present invention are disclosed in, e.g., Japanese Patent Laid-Open Publication Nos. 7-295414, 8-137311, 11-297463, and 11-311910.

SUMMARY OF THE INVENTION

It is therefore an object of the present invention to provide a fixing device for an image forming apparatus capable of reducing the loss of thermal energy as far as possible.

A fixing device using induction heating for an electrophotographic image forming apparatus of the present invention includes a heat roller and a press roller for fixing a toner image on a recording medium while conveying the recording medium. A coil unit is located outside of the heat roller and upstream of a nip between the heat roller and the press roller in the direction of rotation of the heat roller for generating an induced magnetic flux.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
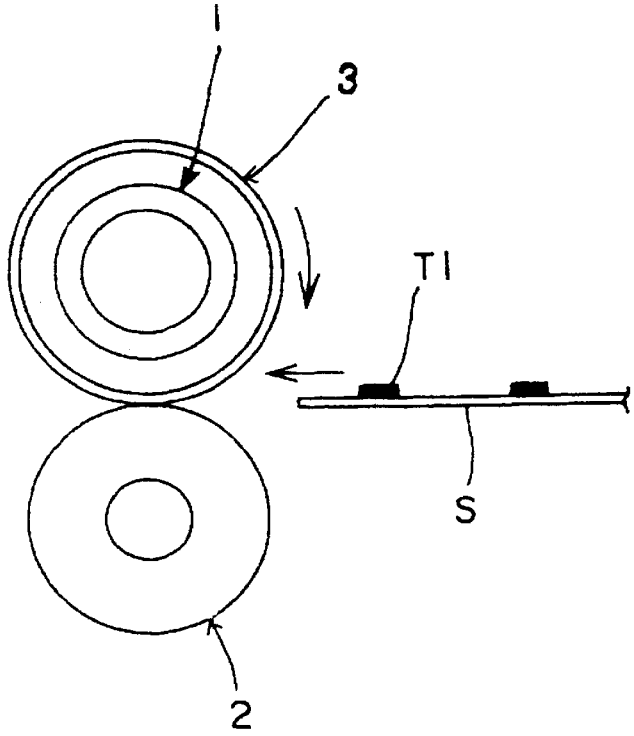
FIG. 1 PRIOR ART
FIG. 1 is a sectional side elevation showing a conventional fixing device using induction heating.

To better understand the present invention, brief reference will be made to a conventional fixing device using induction heating, shown in FIGS. 1 and 2. As shown, the fixing device includes a press roller 2 and a heat roller 3 pressed against each other. The heat roller 3 is rotatable clockwise, as indicated by an arrow in FIG. 1. A paper sheet or similar recording medium S carries a toner image T1 to be fixed by the fixing device thereon. The press roller 2 and heat roller 3 cooperate to fix the toner image T1 on the paper sheet S with heat and pressure while conveying the paper sheet S in a direction indicated by an arrow in FIG. 1.

Figure 2:
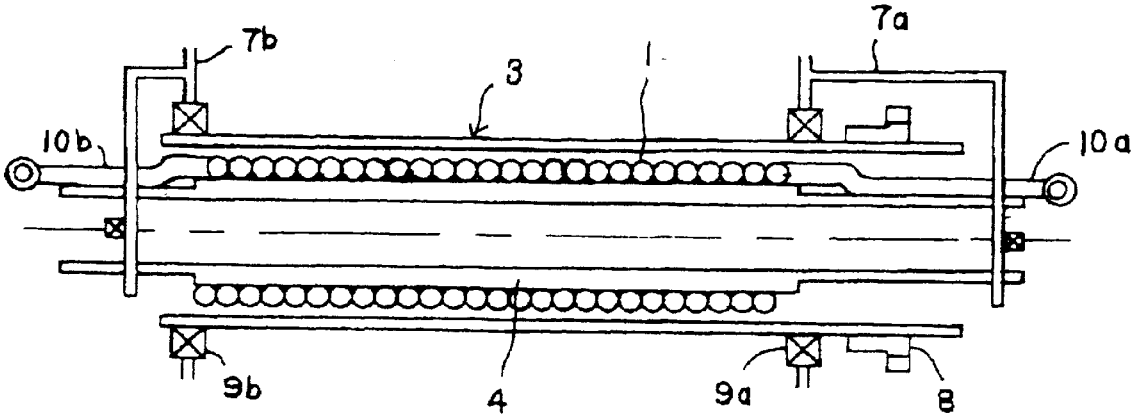
FIG. 2 PRIOR ART
FIG. 2 is a sectional front view of the conventional fixing device.

As shown in FIG. 2, the heat roller 3 is rotatably supported by a pair of bearings 9*a* and 9*b*. A gear 8 is mounted on one end portion of the heat roller 3 and held in mesh with a drive gear not shown. The drive gear drives the gear 8 that in turn causes the heat roller 3 to rotate. The heat roller 3 has a core formed of stainless steel, iron or similar magnetic material and covered with a parting layer implemented by fluorocarbon resin. While the heat roller 3 is implemented as a straight hollow cylinder, it may have greater wall thickness at opposite end portions than at the other portion which the paper sheet S is expected to contact.

The heat roller 3 accommodates an induction coil 1 forming part of an induction heating device and implemented by, e.g., a litz wire. The induction coil 1 is wound round a cylindrical stationary bobbin 4 formed of an insulator. Leads 10*a* and 10*b* extend out from opposite ends of the induction coil 1. High frequency current is fed to the induction coil 1 via the leads 10*a* and 10*b*. Brackets 7*a* and 7*b* are affixed to the sidewalls of the fixing device and support the bobbin 4.

In operation, high frequency current is fed to the induction coil 1 in order to form a high frequency magnetic field. The magnetic field generates induced eddy current in the core or metallic conductor of the heat roller 3. As a result, the heat roller 3 itself generates heat due to its own skin resistance on the basis of Joule heat. In this manner, the surface of the heat roller 3 is heated to a desired temperature.

The above conventional fixing device using induction heating has the problem discussed earlier.

Figure 3:
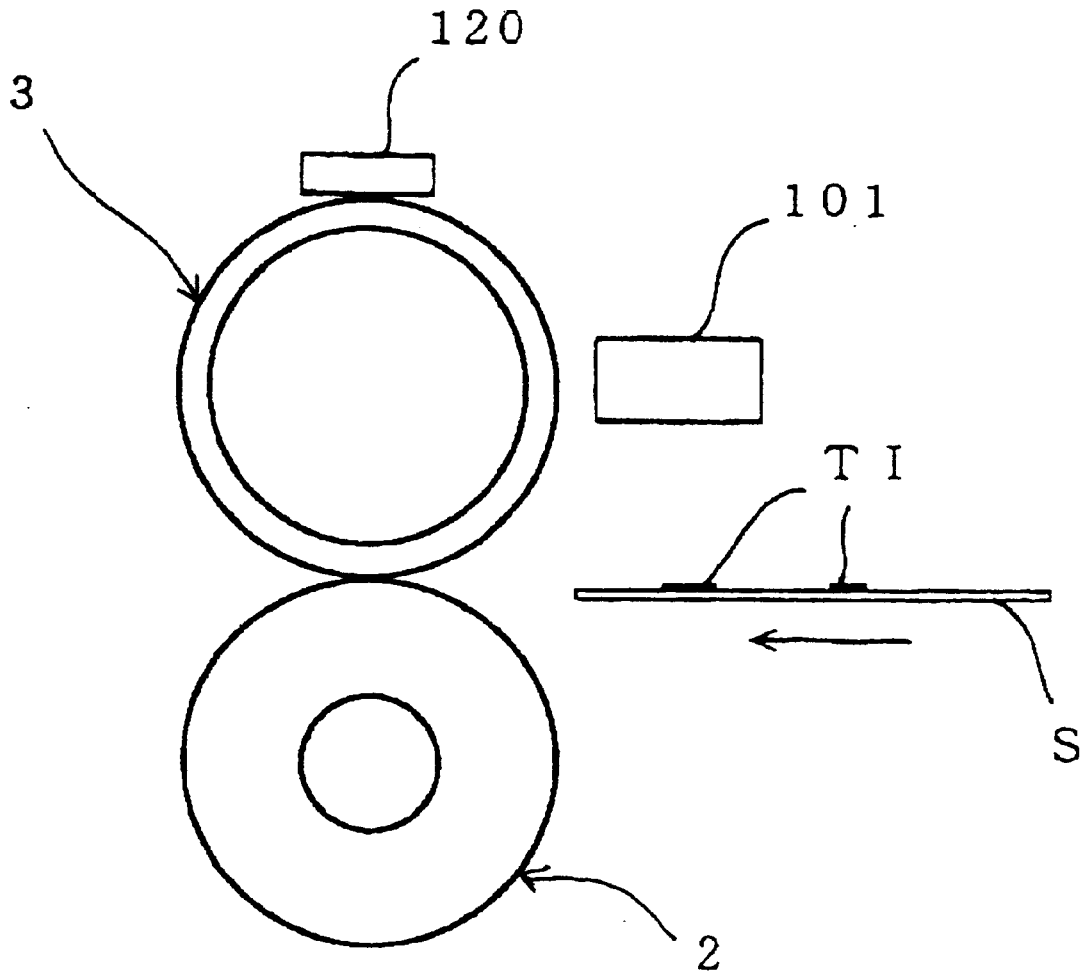
FIG. 3 is a sectional side elevation showing a fixing device embodying the present invention.

Referring to FIG. 3 a fixing device embodying the present invention is shown in a sectional view corresponding to the section view of FIG. 2. As shown, the fixing device includes a press roller 2 and a heat roller 3 pressed against each other. The heat roller 3 is rotatable clockwise, as viewed in FIG. 3.

A paper sheet or similar recording medium S carries a toner image T1 to be fixed by the fixing device thereon. The press roller 2 and heat roller 3 cooperate to fix the tone image T1 on the paper sheet S with heat and pressure while conveying the paper sheet S in a direction indicated by an arrow in FIB. 3.

A coil unit 101 for induction heating, i.e., for generating an induced magnetic flux is positioned upstream of a nip between the press roller 2 and the heat roller 3 in the direction of rotation of the heat roller 3. While the coil unit 101 concentratedly heats a portion of the surface of the heat roller 3 facing it, a temperature sensor 120 senses the surface temperature of the heat roller 3. The temperature sensor 120 is located upstream of the coil unit 101 in the direction of rotation of the heat roller 3. The temperature sensor 120 is angularly spaced from the coil unit 101 by substantially the same distance as the coil unit 101 is spaced from the nip between the press roller 2 and the heat roller 3.

In the illustrative embodiment, the coil unit 101 starts heating the heat roller 3 in synchronism with the arrival of the paper sheet S at the roller 3. More specifically, the position of the heat roller 3 where the coil unit 101 started heating the roller 3 meets the leading edge of the sheet S. In this case, however, the heat of the heat roller 3 diffuses on the surface of and in the roller 3 and to the space around the roller 3 before the surface of the roller 3 reaches the nip between the roller 3 and the press roller 2. In addition, the paper sheet S absorbs the heat of the heat roller 3 during fixation. It is therefore necessary to heat the heat roller 3 in consideration of the decrease in the heat of the heat roller 3.

The coil unit 101 may start heating the heat roller 3 at the same time as the heat roller 3 starts rotating, as in a conventional fixing device of this type. This is successful to raise the temperature of the heat roller 3 beforehand and therefore to enhance the fixing ability of the fixing device. Further, the time when the paper sheet S moves past the heat roller 3 may be sensed in order to control the degree of power to be fed to the coil unit 101. More specifically, power being input to the coil unit 101 may be control led in accordance with whether or not the absorption of heat by the paper sheet S occurs. This kind of control allows a minimum of heat stored in the heat roller 3 to be radiated without being used, thereby obviating the waste of thermal energy.

Figure 4:
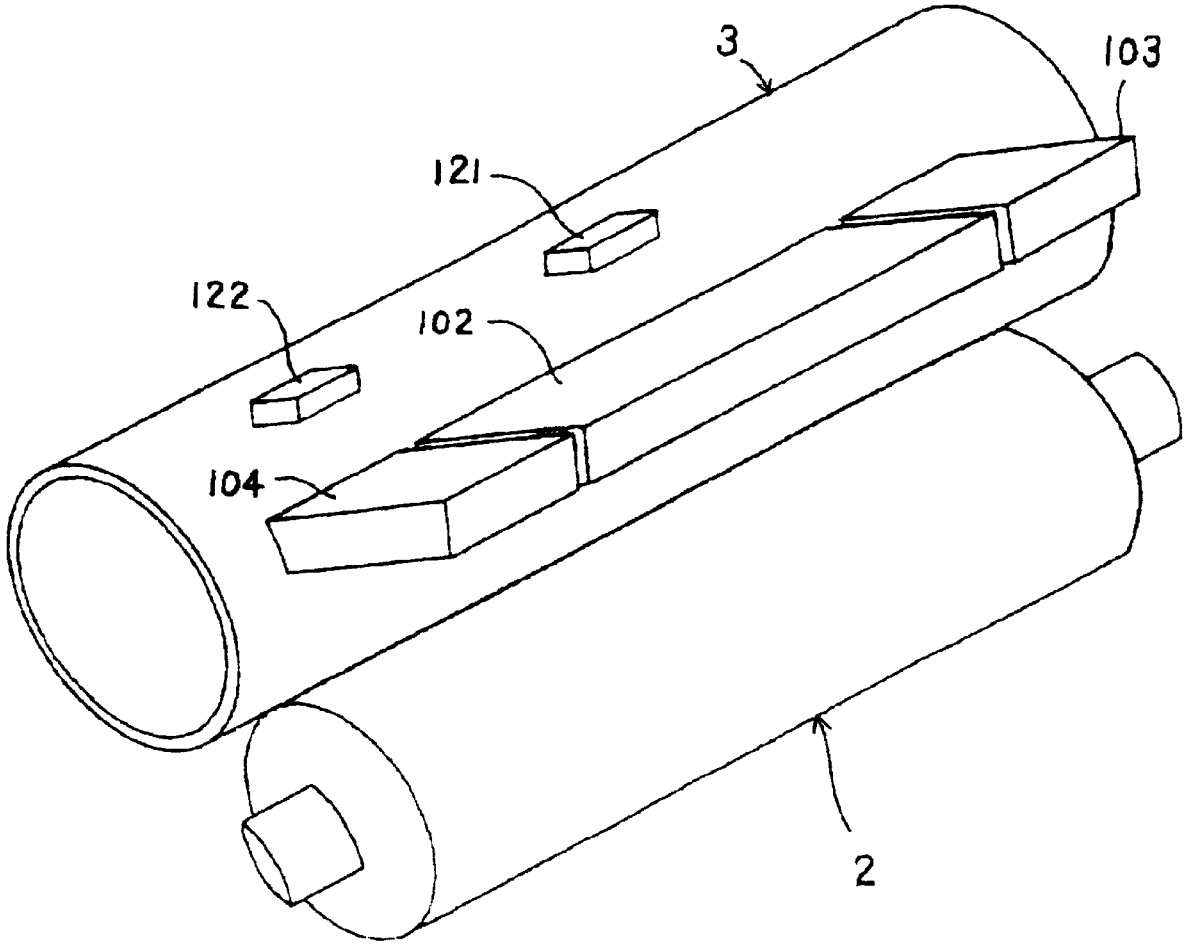
FIG. 4 is an isometric view showing a modification of the illustrative embodiment.

FIG. 4 shows a modification of the above embodiment. As shown, a plurality of coil units 102, 103 and 104 each for producing a particular induction flux are arranged side by side in the axial direction of the heat roller 3. When the reference for the passage of the paper sheet S is defined at the center, the coil units 102, 103 and 104 are arranged symmetrically with respect to the center. That is, the first coil unit 102 is located at the center while the second and third coil units 103 and 104 are respectively located at the drive side and non-drive side. Temperature sensors 121 and 122 responsive to the surface temperature of the heat roller 3 are positioned upstream of the coil units 102 and 104, respectively, in the same positional relation as the temperature sensor 120, FIG. 3. The temperature sensors 121 and 122 respectively adjoin the intermediate portion and one end portion of the heat roller 3. The single temperature sensor 122 adjoining one end portion of the heat roller 3 suffices because opposite ends are generally of substantially the same temperature. However, two temperature sensors may respectively adjoin the opposite ends of the heat roller 3, if desired. When the reference for the passage of the paper sheet S is defined at one side, coil units and temperature sensors may be substantially evenly distributed in the axial direction of the heat roller 3. In any case, power is selectively fed to the coil units adjoining the end portions of the heat roller 3 in accordance with the paper size.

Figure 5:
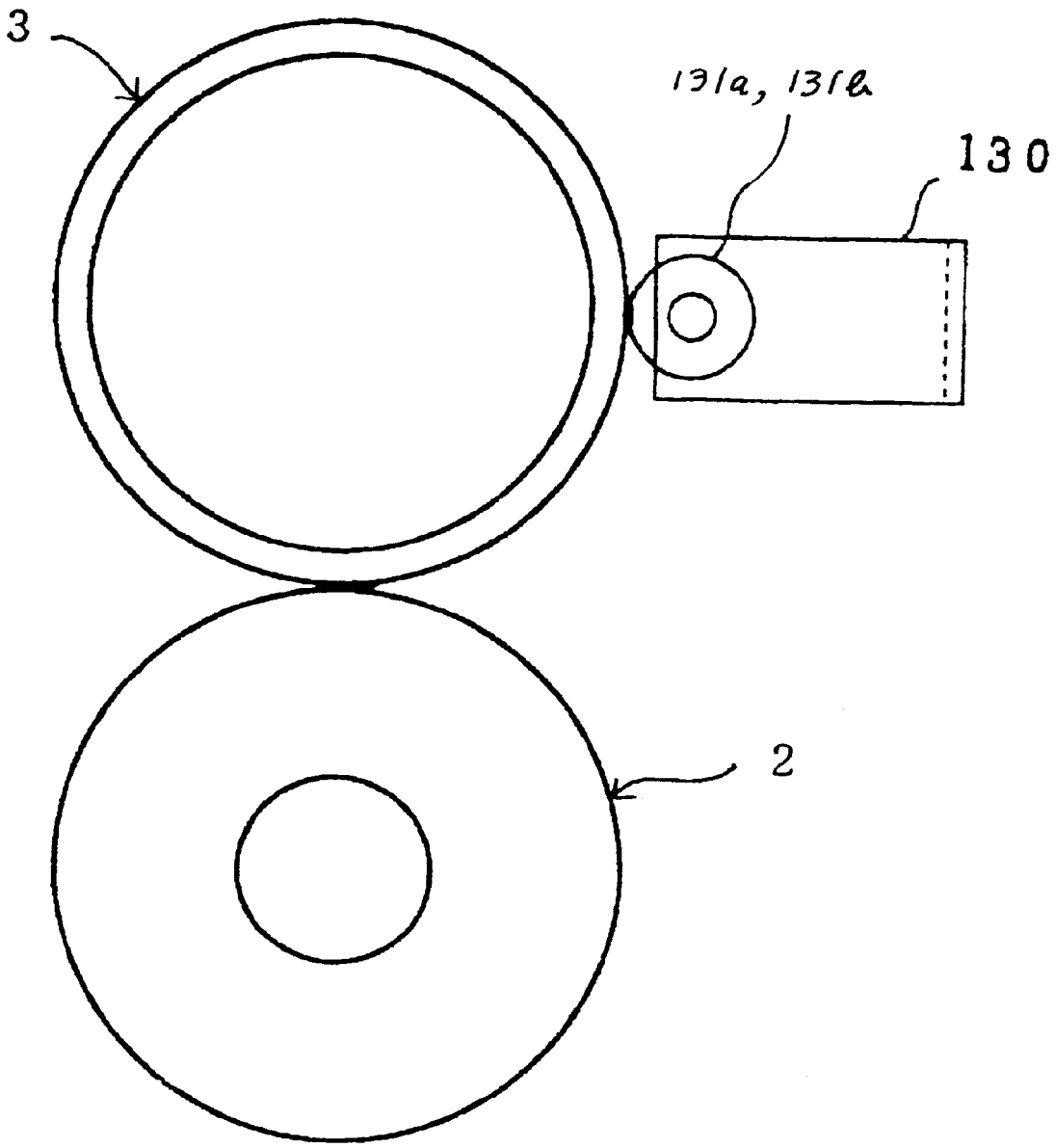
FIG. 5 is a side elevation showing a specific configuration for maintaining a preselected gap between coil units and a heat roller included in the modification of FIG. 4.
Figure 6:
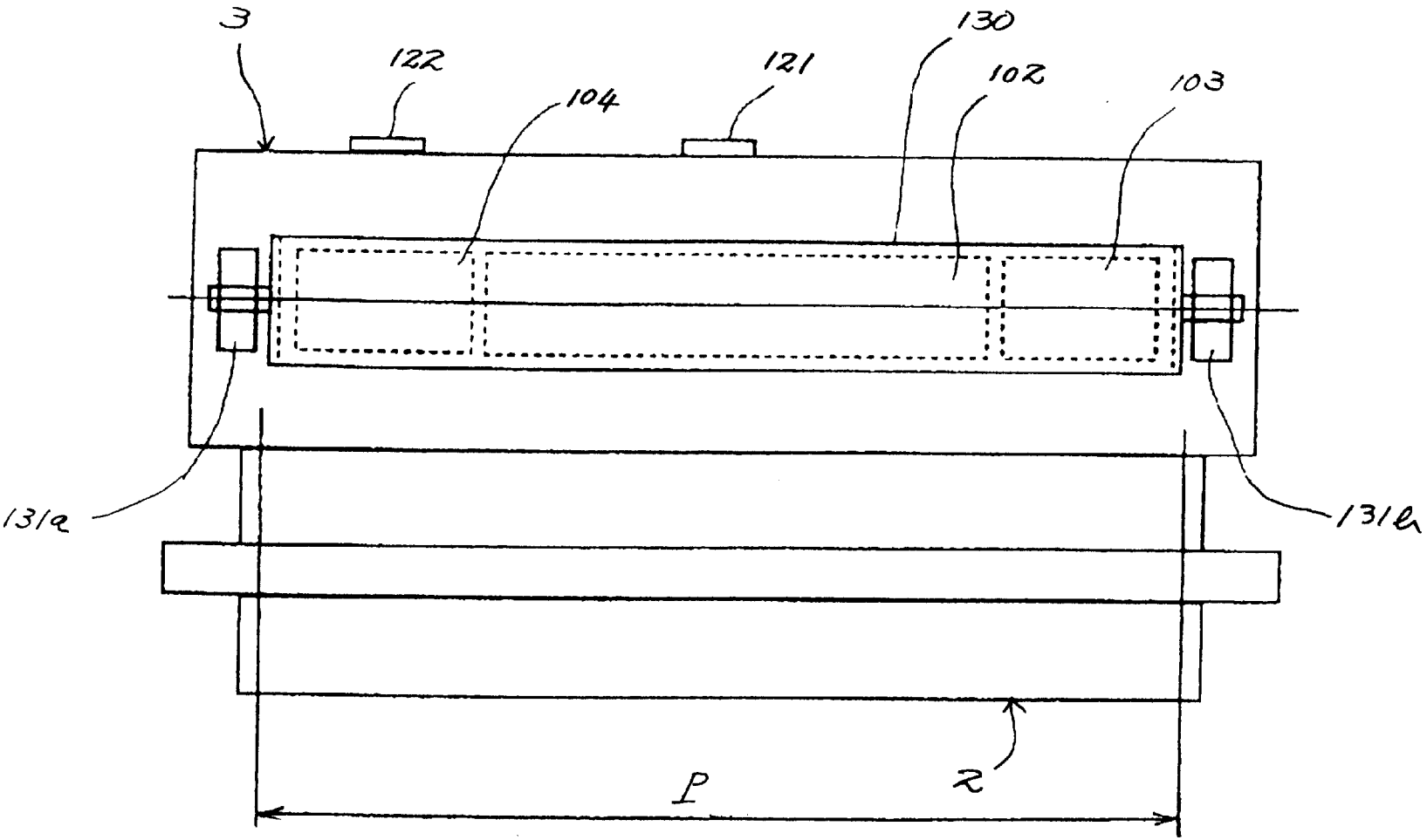
FIG. 6 is a sectional front view of the configuration shown in FIG. 5.

FIGS. 5 and 6 show a specific configuration for maintaining a preselected gap between the coil units 102 through 104 and the heat roller 3. As shown, the coil units 102 through 104 are mounted on a bracket 130. Support rollers 131*a* and 131*b* are implemented by ball bearings and mounted on opposite ends of the bracket 130 outside of a range P where the paper sheet S is passed. The support rollers 131*a* and 131*b* are held in contact with and rotated by the heat roller 3 in order to maintain the above gap.

Figure 7:
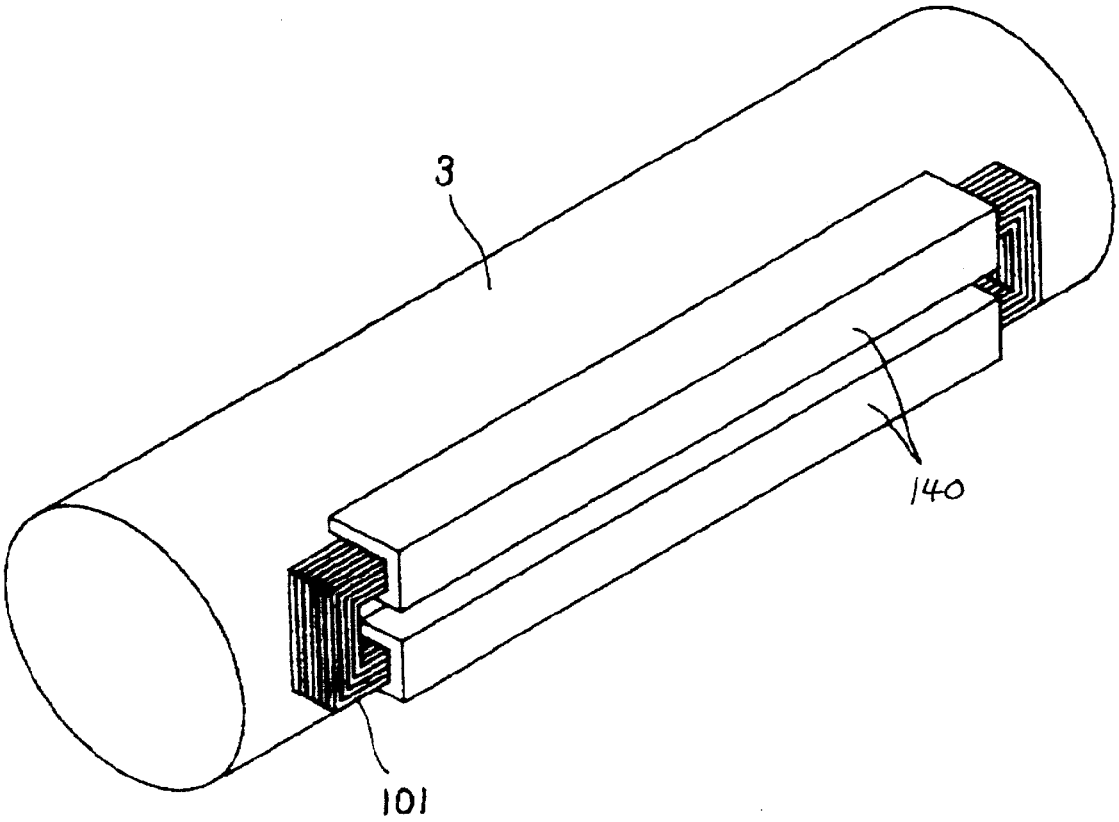
FIG. 7 is an isometric view showing another modification of the illustrative embodiment.

FIG. 7 shows another modification of the illustrative embodiment. As shown, two magnetic members 140 each cover part of particular longer portion of the coil unit 101 in order to cause the magnetic flux density to concentrate on the portion of the heat roller 3 to be heated. This successfully reduces the leak of the magnetic flux to the outside. To further reduce the leak of the magnetic flux, two magnetic members similar to the magnetic members 140 may be respectively assigned to opposite shorter portions of the coil unit 101. While the magnetic members 140 each are shown as being implemented as a single body, each of them achieves the above function even when divided into a plurality of parts.

In summary, it will be seen that the present invention provides a fixing device using induction heating that achieves various unprecedented advantages, as enumerated below.

(1) A coil unit for generating an induced magnetic flux is positioned outside of a heat roller and upstream of a nip between the heat roller and a press roller in the direction of rotation of the heat roller. The coil unit concentratedly heats the heat roller and thereby efficiently feeds heat to a recording medium. A plurality of coil units may be arranged in the axial direction of the heat roller in order to insure efficient heating based on the size of the recording medium.

(2) Power is fed to the coil unit in synchronism with the arrival of the recording medium at the nip, minimizing the radiation of heat.

(3) When power is fed to the coil unit at the same time as the heat roller starts rotating, the heat roller is heated beforehand so as to enhance the fixing ability of the fixing device.

(4) When the amount of power to be fed to the coil unit is control led in accordance with the presence/absence of the recording medium, wasteful heating of the heat roller is obviated.

(5) A temperature sensor responsive to the surface temperature of the heat roller is positioned upstream of the coil unit in the direction of rotation of the heat roller. With the temperature sensor, it is possible to delicately and accurately control the supply of power to the coil unit.

(6) When the amount of power to be fed to the coil unit is controlled in accordance with the temperature being sensed by the temperature sensor, only a necessary amount of power can be fed in order to obviate wasteful heat radiation.

(7) Means for maintaining a preselected gap between the coil unit and the heat roller is provided and allows the coil unit to heat the heat roller at a position as close to the heat roller as possible. This successfully enhances efficient heating.

(8) A magnetic member for causing magnetic flux density to concentrate surrounds part of the coil unit, so that the magnetic flux can concentrate on the heat roller.

Various modifications will become possible for those skilled in the art after receiving the teachings of the present disclosure without departing from the scope thereof.

What is claimed is:

1. A fixing device using induction heating, comprising:

a heat roller and a press roller for fixing a toner image on a recording medium while conveying said recording medium; and a coil unit located outside of said heat roller and entirely upstream of a nip between said heat roller and said press roller in a direction of rotation of said heat roller for generating an induced magnetic flux.

2. A fixing device as claimed in claim 1, wherein said coil unit comprises a plurality of coil units arranged side by side in an axial direction of said heat roller.

3. A fixing device as claimed in claim 2, wherein power is fed to said coil unit in synchronism with an arrival of the recording medium at the nip.

4. A fixing device as claimed in claim 2, wherein power is fed to said coil unit at the same time as said heat roller starts rotating to thereby heat said heat roller beforehand.

5. A fixing device as claimed in claim 2, wherein an amount of power to be fed to said coil unit is controlled in accordance with presence/absence of the recording medium.

6. A fixing device as claimed in claim 2, further comprising a temperature sensor positioned upstream of said coil unit in the direction of rotation of said heat roller for sensing a surface temperature of said heat roller.

7. A fixing device as claimed in claim 6, wherein an amount of power to be fed to said coil unit is control led in accordance with the surface temperature sensed by said temperature sensor.

8. A fixing device as claimed in claim 2, further comprising means for maintaining a preselected gap between said coil unit and said heat roller.

9. A fixing device as claimed in claim 2, further comprising a magnetic member covering a part of said coil unit for causing a magnetic flux density to concentrate on said heat roller.

10. A fixing device as claimed in claim 1, wherein power is fed to said coil unit in synchronism with an arrival of the recording medium at the nip.

11. A fixing device as claimed in claim 1, wherein power is fed to said coil unit at the same time as said heat roller starts rotating to thereby heat said heat roller beforehand.

12. A fixing device as claimed in claim 1, wherein an amount of power to be fed to said coil unit is control led in accordance with presence/absence of the recording medium.

13. A fixing device as claimed in claim 1, further comprising a temperature sensor positioned upstream of said coil unit in the direction of rotation of said heat roller for sensing a surface temperature of said heat roller.

14. A fixing device as claimed in claim 13, wherein an amount of power to be fed to said coil unit is control led in accordance with the surface temperature sensed by said temperature sensor.

15. A fixing device as claimed in claim 1, further comprising means for maintaining a preselected gap between said coil unit and said heat roller.

16. A fixing device as claimed in claim 1, further comprising a magnetic member covering a part of said coil unit for causing a magnetic flux density to concentrate on said heat roller.

17. A fixing device using induction heating, comprising:

a heat roller and a press roller for fixing a toner image on a recording medium while conveying said recording medium;

a coil unit located outside of said heat roller and upstream of a nip between said heat roller and said press roller in a direction of rotation of said heat roller for generating an induced magnetic flux; and means for maintaining a preselected gap between said coil unit and said heat roller.

18. A fixing device as claimed in claim 17, wherein said coil unit comprises a plurality of coil units arranged side by side in an axial direction of said heat roller.

19. A fixing device using induction heating, comprising:

a heat roller and a press roller for fixing a toner image on a recording medium while conveying said recording medium;

a coil unit located outside of said heat roller and upstream of a nip between said heat roller and said press roller in a direction of rotation of said heat roller for generating an induced magnetic flux; and a magnetic member covering a part of said coil unit for causing a magnetic flux density to concentrate on said heat roller.

20. A fixing device as claimed in claim 19, wherein said coil unit comprises a plurality of coil units arranged side by side in an axial direction of said heat roller.

21. A fixing device using induction heating, comprising:

a heat roller and a press roller for fixing a toner image on a recording medium while conveying said recording medium;

a coil unit located outside of said heat roller and upstream of a nip between said heat roller and said press roller in a direction of rotation of said heat roller for generating an induced magnetic flux; and a temperature sensor located outside of said heat roller and upstream of said heat roller in a direction of rotation of said heat roller for sensing a surface temperature of said heat roller, wherein said temperature sensor is angularly spaced from said coil unit by a first distance substantially equal to a second distance which said coil unit is spaced from said nip.

* * * * *